US006591538B2

(12) United States Patent
Holler

(10) Patent No.: US 6,591,538 B2
(45) Date of Patent: Jul. 15, 2003

(54) SCOPE MOUNT FOR FIREARMS HAVING PROJECTILES TRAVELING AT SUBSONIC SPEED AND ASSOCIATED METHODS

(76) Inventor: Christopher A. Holler, 301 S. Orlando Ave. Suite 200, Maitland, FL (US) 32751

( * ) Notice: Subject to any disclaimer, the term of this patent is extended or adjusted under 35 U.S.C. 154(b) by 0 days.

(21) Appl. No.: 09/957,388

(22) Filed: Sep. 20, 2001

(65) Prior Publication Data

US 2003/0051386 A1 Mar. 20, 2003

(51) Int. Cl.[7] ..... F41G 1/38
(52) U.S. Cl. ..... 42/125; 42/126
(58) Field of Search ..... 42/111–115, 124–126, 42/135–139; 248/205.1, 274.1

(56) References Cited

U.S. PATENT DOCUMENTS

| | | | | | |
|---|---|---|---|---|---|
| 514,562 | A | * | 2/1894 | Lyman | 42/139 |
| 677,288 | A | | 6/1901 | Swasey | |
| 681,202 | A | | 8/1901 | Zeng, Jr. | |
| 691,248 | A | | 1/1902 | Zeng, Jr. | |
| 906,751 | A | | 12/1908 | Swasey | |
| 1,613,807 | A | | 1/1927 | Rutherford et al. | |
| 2,127,174 | A | * | 8/1938 | Hunt | 42/139 |
| 2,155,390 | A | * | 4/1939 | Arden | 42/122 |
| 2,365,976 | A | | 12/1944 | Sorensen | 33/50 |
| 2,583,260 | A | * | 1/1952 | Felix | 42/126 |
| 2,871,566 | A | * | 2/1959 | Everitt | 42/137 |
| 3,037,288 | A | | 6/1962 | Detrich et al. | 33/50 |
| 3,100,936 | A | * | 8/1963 | Angelica | 42/136 |
| 3,406,455 | A | * | 10/1968 | Akin, Jr. | 248/205.1 |
| 3,419,334 | A | | 12/1968 | Hubbard | 356/254 |
| 3,556,666 | A | | 1/1971 | Lichtenstern | 356/249 |
| 3,662,469 | A | * | 5/1972 | Charron | 42/137 |
| 3,882,609 | A | | 5/1975 | Troutman | 33/260 |
| 3,922,794 | A | * | 12/1975 | Ackerman, Jr. | 42/126 |
| 4,367,606 | A | | 1/1983 | Bechtel | 42/1 |
| 4,873,779 | A | | 10/1989 | Ellison et al. | 42/101 |
| 4,961,265 | A | | 10/1990 | Roberts | 33/265 |
| 5,274,941 | A | | 1/1994 | Moore | 42/101 |
| 5,375,361 | A | * | 12/1994 | Rustick | 42/125 |
| 5,400,539 | A | | 3/1995 | Moore | 42/101 |
| 5,406,733 | A | | 4/1995 | Tarlton et al. | 42/101 |
| 5,428,915 | A | * | 7/1995 | King | 42/126 |
| 5,442,863 | A | * | 8/1995 | Fazely | 33/265 |
| 5,481,807 | A | * | 1/1996 | Ploot | 124/87 |
| 5,956,190 | A | * | 9/1999 | Sieg | 359/827 |

* cited by examiner

*Primary Examiner*—Charles T. Jordan
*Assistant Examiner*—Tara M Golba
(74) *Attorney, Agent, or Firm*—Allen, Dyer, Doppelt, Milbrath & Gilchrist, P.A.

(57) ABSTRACT

A firearm scope mounting apparatus and methods of positioning a firearm scope are provided. The firearm scope mounting apparatus preferably advantageously includes a pivot base having a bottom member adapted to be connected to a firearm and a top member overlying the bottom member and pivotally connected to the bottom member along a proximal end portion thereof. An elevation member is adapted to be connected to the distal end portion of the pivot base to elevate the top member of the pivot base above the bottom member of the pivot base along the distal end portion thereof and thereby increase the distance between the top and bottom members of the pivot base adjacent the distal end portion of the pivot base. A firearm scope connector preferably is positioned to connect to a medial portion of the top member of the pivot base and is adapted to connect a firearm scope to the pivot base. A scope positioner preferably is adapted to overlie the firearm scope connector to move a firearm scope in lateral and longitudinal directions.

31 Claims, 5 Drawing Sheets

SCOPE MOUNT FOR FIREARMS HAVING PROJECTILES TRAVELING AT SUBSONIC SPEED AND ASSOCIATED METHODS

FIELD OF THE INVENTION

The present invention relates to the field of firearm scopes and, more particularly, scope mounts for firearms.

BACKGROUND OF THE INVENTION

Firearms are generally capable of firing projectiles at various speeds, i.e., hypersonic and subsonic speeds. A projectile, e.g., a bullet, fired at hypersonic speed is likely to make contact with an object before naturally landing. A projectile fired at hypersonic speeds, therefore, generally travels along a substantially linear path and is not substantially affected by cross winds or breezes.

Projectiles fired at subsonic speeds, however, generally do not travel along linear paths of travel after being fired from a firearm. More particularly, the paths of travel of these projectiles are greatly affected by cross winds and breezes. The paths of travel of projectiles fired at subsonic speeds are therefore generally nonlinear, i.e., arched. Further, the trajectory of projectiles that are fired at subsonic speeds are greatly affected when the projectile must be fired over a great distance.

Firearm scope mounts used for firearms adapted to fire projectiles at subsonic speeds are known. For example, U.S. Pat. No. 4,873,779, titled "Scope Mount Base For A Black Powder Rifle" by Ellison et al. discloses a scope mount base that enables a firearm scope to be mounted to a black powder rifle without the need to drill additional mounting holes. This mounting device, however, does not allow for varying degrees of freedom to move a firearm scope mounted thereon to accurately locate a target. This firearm scope mount is also disadvantageous because it requires somewhat complicated assembly and installation.

Other firearm scope mounts are adapted to make quick adjustments to a firearm scope positioned thereon. For example, U.S. Pat. No. 3,882,609, titled "Telescopic Sight Mounting Means" by Troutman discloses a telescopic gun sight mount wherein the sight may be adjusted for a desired range by gradually raising or lowering the sight. The sight mount disclosed in Troutman '609, however, can only be used for locating targets for projectiles fired from a firearm at sonic or hypersonic speeds. Further, the sight mount is only adapted to make adjustments for the distances of targets. As mentioned above, projectiles fired at subsonic speeds generally travel in a nonlinear path. The sight mount of Troutman, however, does not take into account nonlinear travel when used to locate a target.

Known firearm scopes and scope mounts such as seen in Troutman '609, are capable of accounting for such factors as distance and heavy cross winds when used to locate a target. These scopes, however, are not accurate in cases when used to locate targets for projectiles fired at subsonic speeds. Known firearm scopes and scope mounts are disadvantageous because they do not take into account the several other factors, i.e., light breezes, cross winds, distance, drag, and a nonlinear path of travel, that affect the path of a projectile traveling at subsonic speeds. Known firearm scopes and scope mounts are also disadvantageous because they do not provide adequate degrees of freedom to move a firearm scope for accurate targeting. The known firearm scopes and mounts are further disadvantageous because they can be cumbersome, bulky, and very heavy.

SUMMARY OF THE INVENTION

With the foregoing in mind, the present invention advantageously provides a firearm scope mounting apparatus that is light in weight, easy to mount, and allows for three degrees of freedom of a firearm scope mounted thereon. More particularly, the firearm scope mounting apparatus of the present invention advantageously accounts for various factors that affect a projectile fired from a firearm at subsonic speeds. The firearm mounting apparatus of the present invention is preferably made of hard plastic material that advantageously has high strength properties. The firearm mounting apparatus of the present invention is also advantageously light in weight so as to nearly eliminate any added burden to handling a firearm. The present invention further advantageously allows a user to accurately locate targets for a projectile fired from a firearm at subsonic speeds. The present invention advantageously allows a user to position a firearm scope so as to account for factors that affect a projectile fired at subsonic speeds.

More particularly, the present invention provides a firearm scope mounting apparatus for mounting a firearm scope to a firearm adapted to fire a projectile at subsonic speeds. The firearm scope mounting apparatus advantageously includes a pivot base having a bottom member adapted to be connected to a firearm and a top member overlying the bottom member and pivotally connected to the bottom member along a distal end portion thereof. The firearm scope mounting apparatus also advantageously includes an elevation member adapted to be connected to the proximal end portion of the pivot base to elevate the top member of the pivot base above the bottom member of the pivot base along the proximal end portion thereof and thereby increase the distance between the top and bottom members of the pivot base adjacent the proximal end portion of the pivot base. The firearm scope mounting apparatus further advantageously includes a firearm scope connector positioned to connect to a medial portion of the top member of the pivot base and adapted to connect a firearm scope to the pivot base. The firearm scope further advantageously includes a scope positioner adapted to overlie the firearm scope connector to move a firearm scope in lateral and longitudinal directions.

The present invention also advantageously includes methods of positioning a firearm scope connected to a firearm adapted to fire subsonic speed projectiles. A method can advantageously include pivoting a top member of a pivot base having a firearm scope connected thereto. The method can also advantageously include moving a firearm scope in a lateral direction when connected to the pivot base. The method can further advantageously include moving a firearm scope in a longitudinal direction when connected to the pivot base.

The present invention advantageously provides a firearm scope mounting apparatus that advantageously allows a firearm positioned thereon to be positioned in at least three varying positions to account for various factors, e.g., angle or height, lateral, and longitudinal or distance, that affect a projectile fired from a firearm at subsonic speeds. The firearm mounting apparatus of the present invention also advantageously allows a user to accurately fire a projectile fired at subsonic speed from a firearm and traveling along a nonlinear path.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION OF THE PREFERRED EMBODIMENTS

Figure 1:
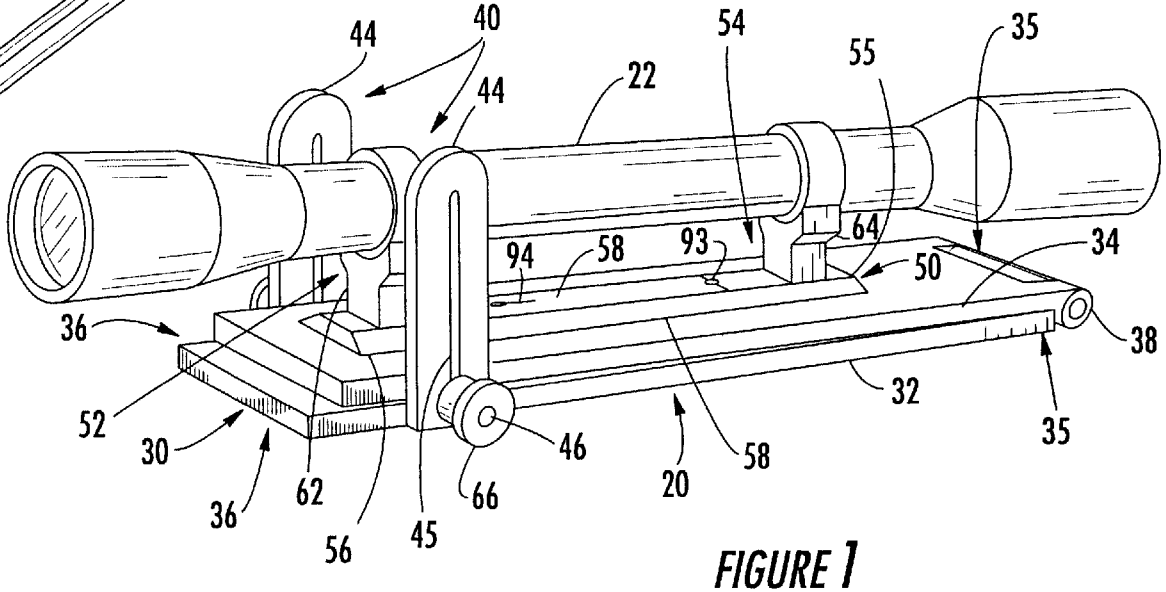
FIG. 1 is a perspective view of a firearm scope mounting apparatus having a firearm scope mounted thereto according to the present invention.

The present invention will now be described more fully hereinafter with reference to the accompanying drawings which illustrate preferred embodiments of the invention. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, the prime notation, if used, indicates similar elements in alternative embodiments.

As shown in FIGS. 1–8, the present invention advantageously provides a firearm scope mounting apparatus 20 and associated methods for a firearm 24 adapted to fire a projectile at subsonic speeds. For example, older firearms, e.g., black powder rifles, and modern firearms, e.g., firearms having elongate barrels for silencing applications, fire projectiles 28, e.g., bullets and lead pellets, at subsonic speeds. The present invention provides a firearm scope mounting apparatus 20 for mounting a firearm scope 22 to a firearm 24 adapted to fire a projectile 28 at subsonic speeds.

Figure 2:
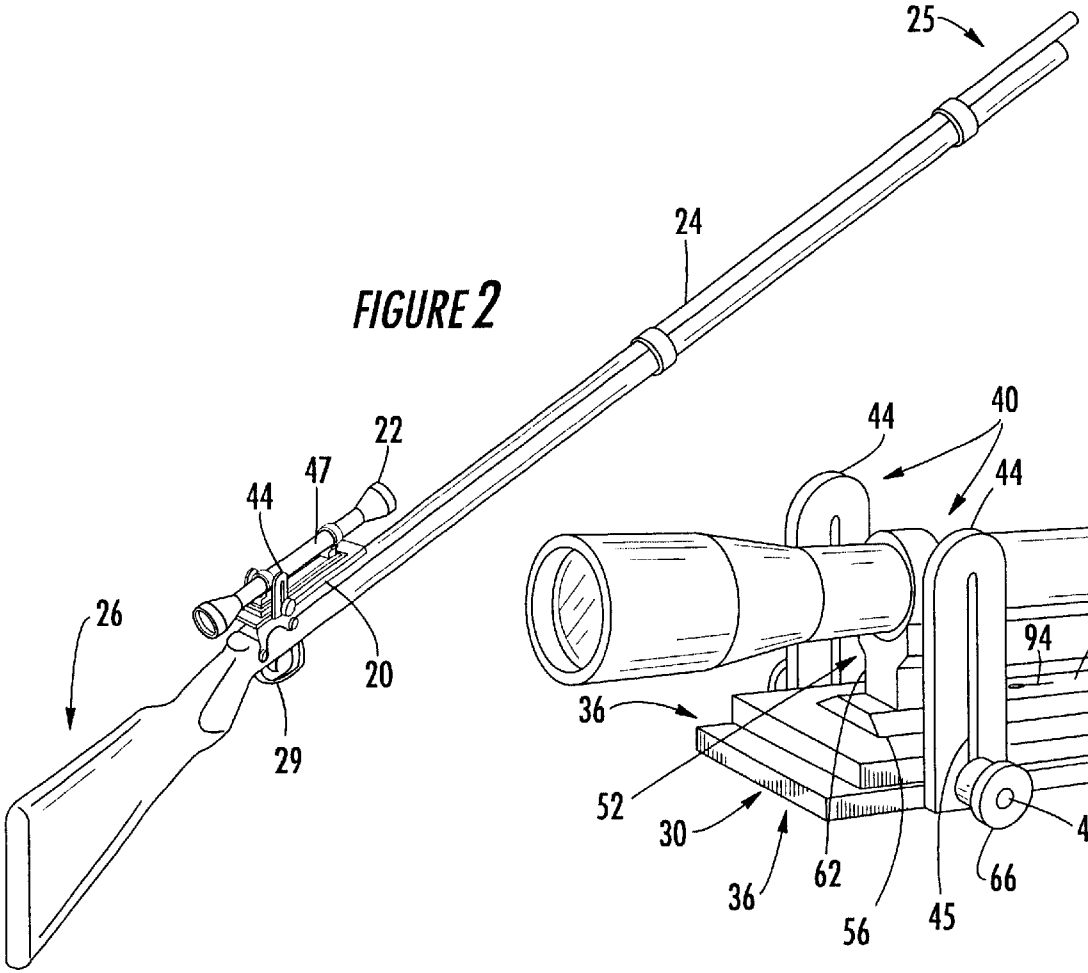
FIG. 2 is a perspective view of a firearm having a firearm scope mounted thereto according to the present invention.
Figure 3:
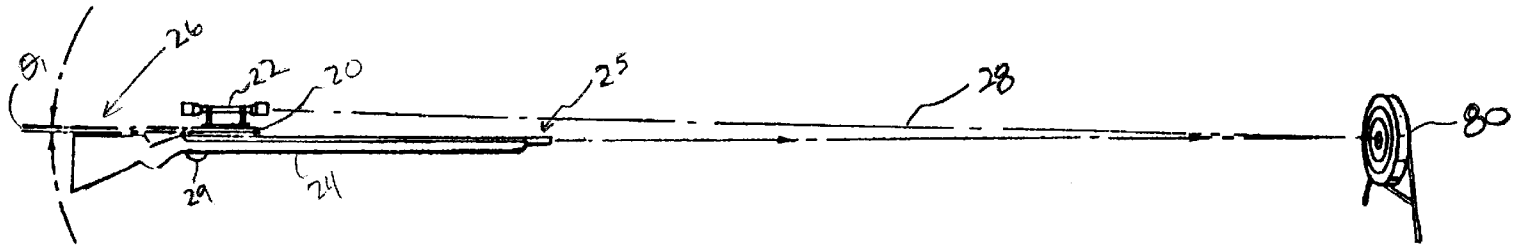
FIG. 3 is an environmental view of a projectile fired from a firearm at a subsonic speed along a first nonlinear path according to the present invention.
Figure 4:
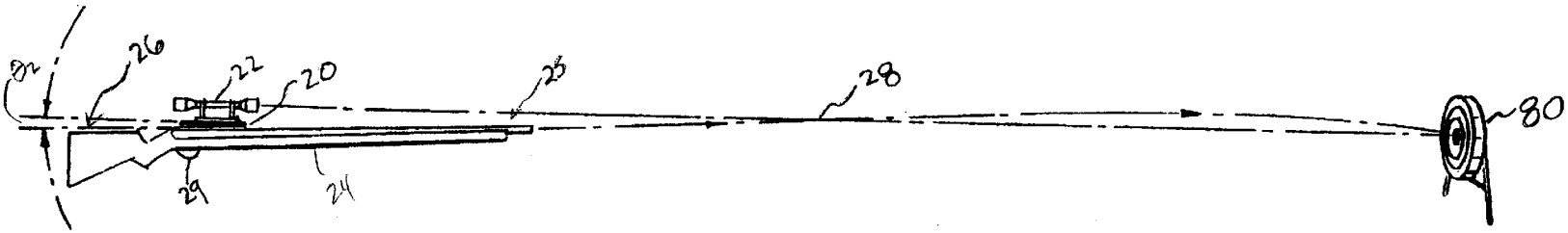
FIG. 4 is another environmental view of a projectile fired from a firearm at a subsonic speed along a second nonlinear path according to the present invention.
Figure 5:
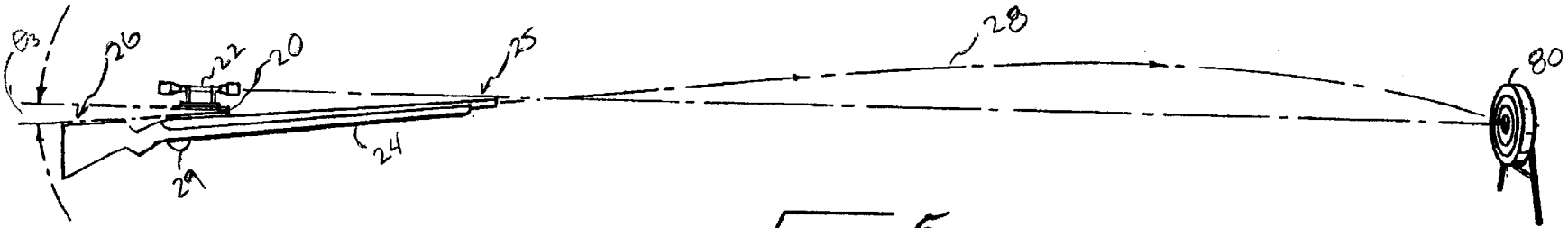
FIG. 5 is yet another environmental view of a projectile fired from a firearm at a subsonic speed along a third nonlinear path according to the present invention.

As illustrated in FIGS. 3–5, projectiles 28 fired at subsonic speeds generally travel along a nonlinear path and can be greatly affected by such minor factors as breezes, cross winds, and drag. The firearm scope mounting apparatus 20 of the present invention preferably has a pivot base 30 which includes a bottom member 32 adapted to be connected to a firearm 24 as illustrated in FIG. 2. The firearm scope mounting apparatus 20 of the present invention is preferably mounted on a proximal end 26 of a firearm 24 and, more preferably, mounted above a trigger mechanism 29 of a firearm 24. The bottom member 32 of the pivot base 30 can advantageously be connected to a firearm 24 using a plurality of fasteners, screws for example, positioned to extend through the bottom portion 32 of the pivot base 30 and into portions of a firearm 24.

The pivot base 30 preferably also has a top member 34 overlying the bottom member 32 and pivotally connected to the bottom member 32 along a distal portion 35 of the pivot base 30. Both the bottom and top members 32, 34 of the pivot base 30 are advantageously formed of metal or high impact plastic. These materials are preferable because of their strength properties, but any material having similar strength properties can be used to form the bottom and top members 32, 34 of the pivot base 30, as understood by those skilled in the art. Lightweight materials are also preferable so as not to increase the burden of handling the firearm 24.

Figure 6:
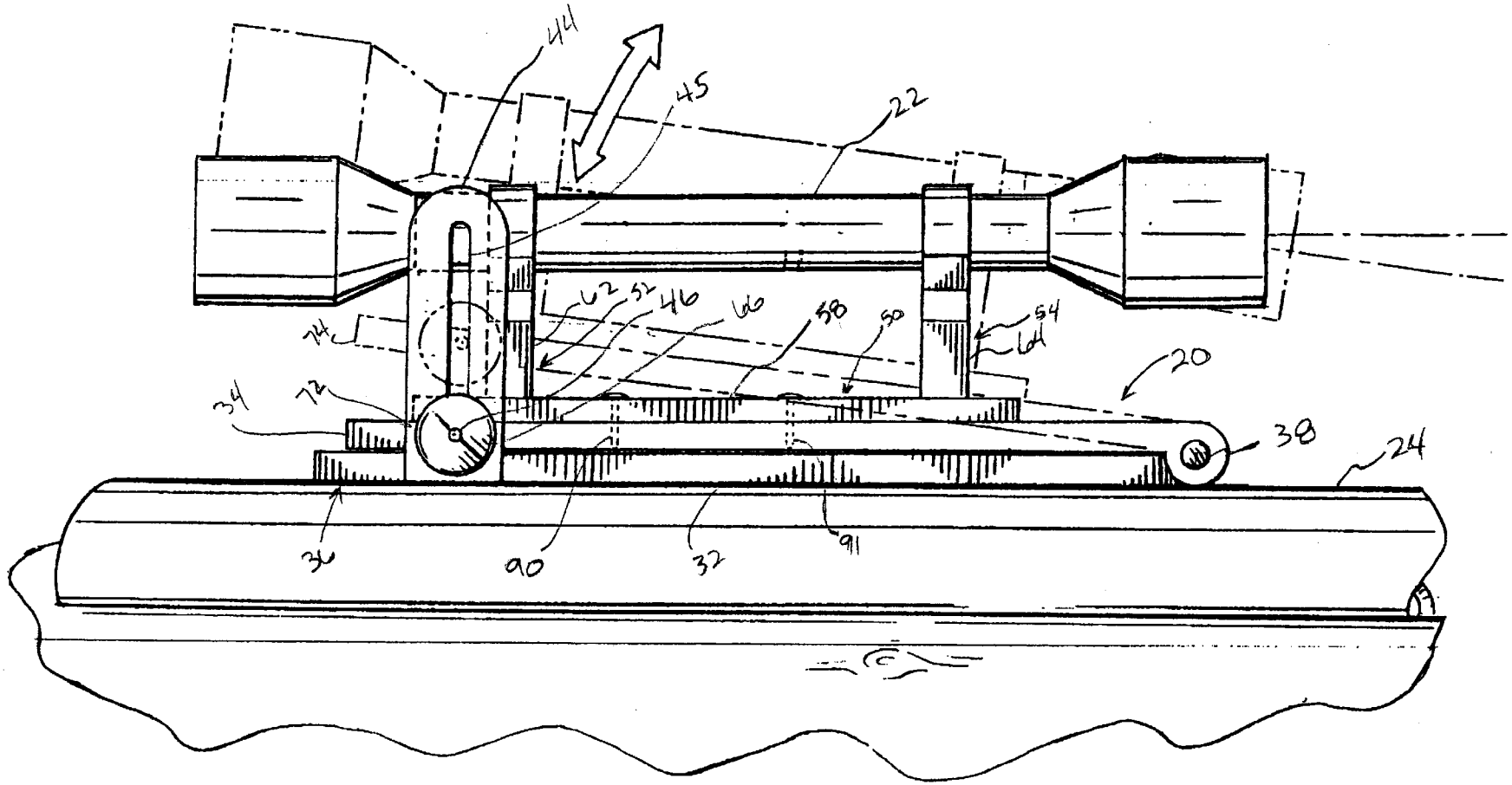
FIG. 6 is a fragmentary perspective view of a firearm scope mounting apparatus having a firearm mounted to a firearm showing a plurality of angled or height positions of movement according to the present invention.
Figure 7:
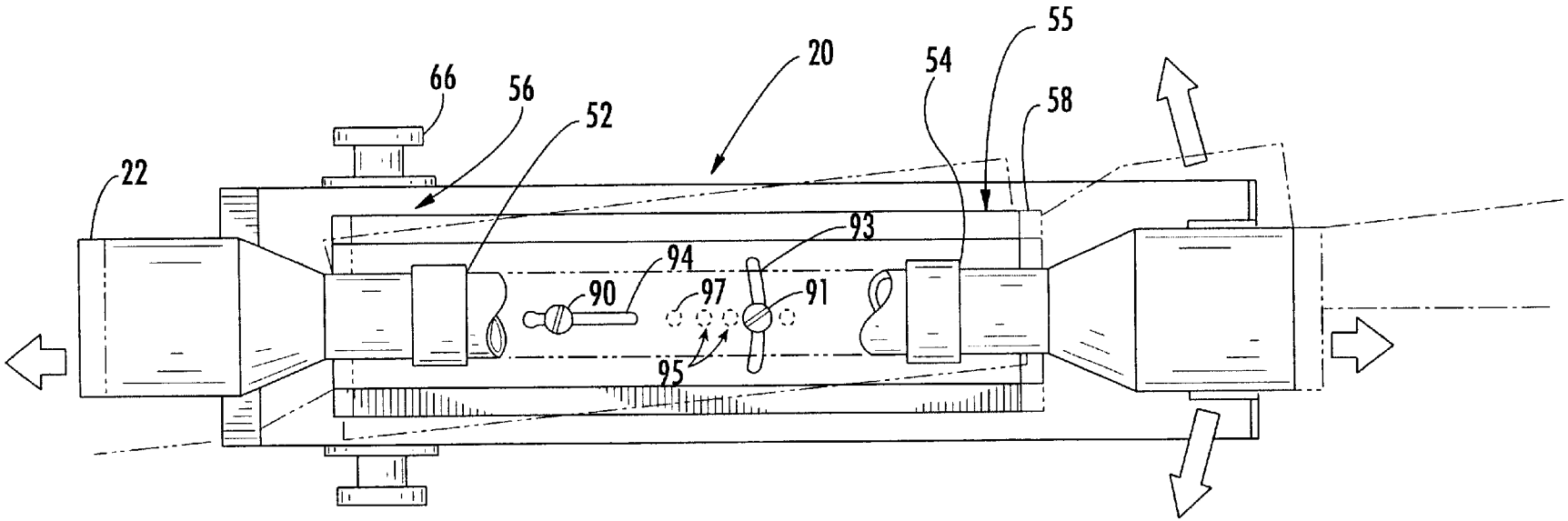
FIG. 7 is a top plan view of a firearm scope mounting apparatus mounted to a firearm showing a plurality of lateral and longitudinal positions of movement according to the present invention.

As best illustrated in FIG. 6, the top member 34 of the pivot base 30 is preferably pivotally connected by a pivot member 38, such as a hinge or other pivot member as understood by those skilled in the art. The top member 34 can also advantageously be pivotally connected to the bottom member 32 by a living hinge, a paumelle hinge, plate hinge, or any other type of hinge as understood by those skilled in the art. The top member 34 of the pivot base 30 also preferably includes at least one pin receiving slot 39 formed therein along a proximal end portion 36 of the pivot base 30. The pin receiving slot 39 can advantageously be a hole, for example, that extends through the top member 34 of the pivot base 30.

Figure 8:
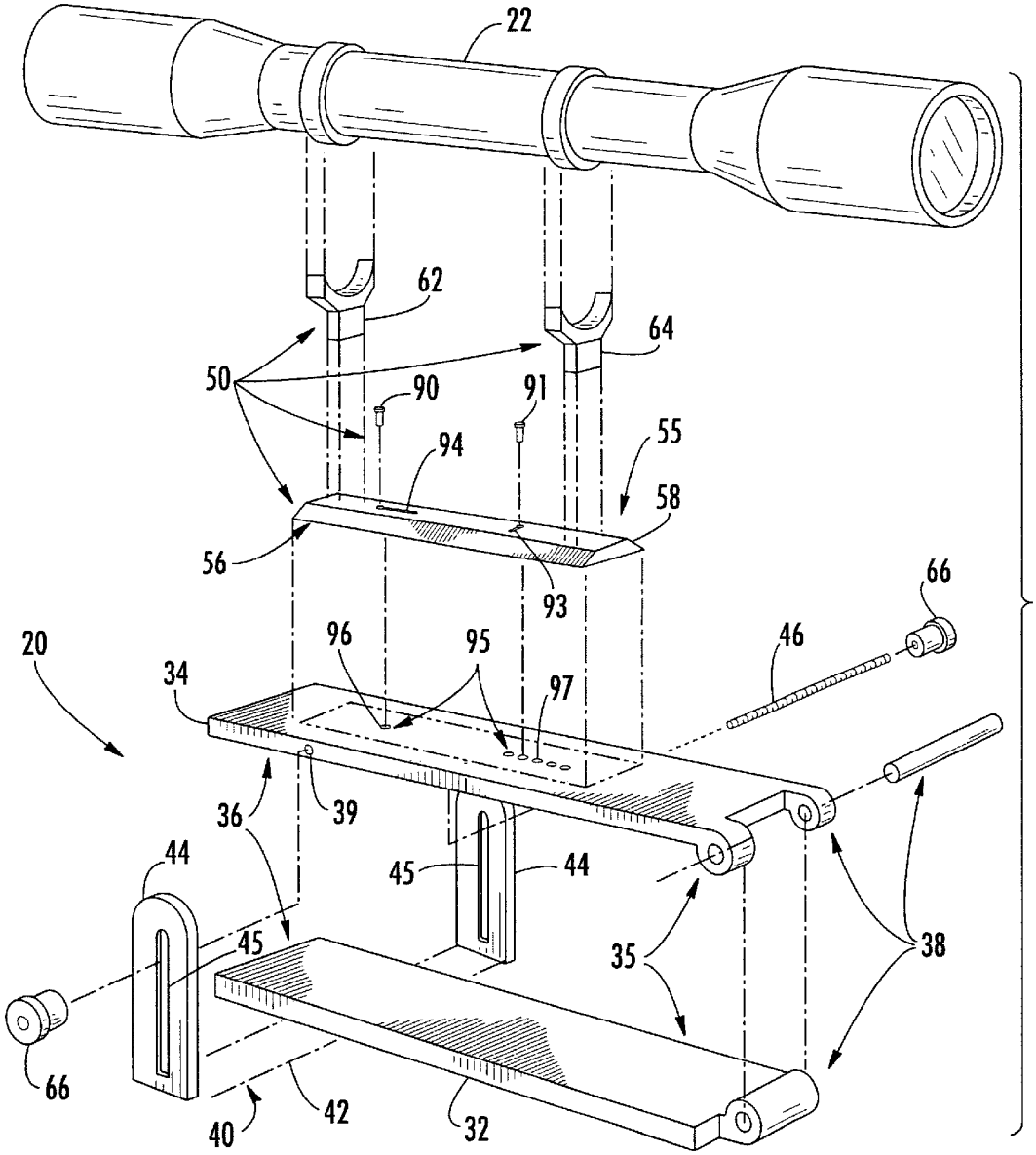
FIG. 8 is an exploded perspective view of the firearm scope mounting apparatus according to the present invention.

As best illustrated in FIG. 8, the firearm scope mounting apparatus 20 of the present invention also preferably includes elevating means adapted to be connected to the proximal end portion 36 of the pivot base 30 for elevating the top member 34 of the pivot base 30 above the bottom member 32 long the proximal end portion 36 thereof to thereby increase he distance between the top and bottom members 34, 32 of the pivot base 30 adjacent the proximal end portion 36 of the pivot base 30. The elevating means can advantageously be provided by an elevation member 40 adapted to be connected to the proximal end portion of the pivot base 30.

The elevation member 40 preferably includes a base 42 adapted to be connected to the proximal end portion 36 of the pivot base 30. More specifically, the base 42 of the elevation member 40 is positioned to extend beneath portions of the bottom member 32 of the pivot base 30. The elevation member 40 also preferably includes a pair of opposing side portions 44 extending upwardly from the base 42. The pair of opposing side portions 44 can advantageously include a slot 45 formed therein. The slots 45 formed in the opposing side portions 44 are preferably positioned parallel one another and extend upwardly a length substantially similar to the length of the opposing side portions 44. The elevation member 40 further preferably includes a pin member 46 adapted to be slidably connected to the pair of opposing side portions 44. The slots 45 formed in the opposing side portions 44 are advantageously wide enough to have a tolerance so that the pin member 46 can move freely through the slots 45. As illustrated in FIG. 8, the pin member 46 can advantageously be adapted to extend through the at least one pin receiving slot 39 formed in the top member 34 of the pivot base 30. More specifically, the pin member 46 can be adapted to slidably contact the slots 45 formed in the opposing side portions 44 of the elevation member 40. The pin member 46 can be formed of a material similar to the pivot base 30, i.e., metal or high impact plastic.

The firearm scope mounting apparatus 20 of the present invention also preferably includes firearm scope connecting means positioned to connect to a medial portion of the top member 34 of the pivot base 30 and adapted for matingly receiving a firearm scope 22. As best illustrated in FIG. 8, the firearm scope 22 connecting means can advantageously be a firearm scope connecting assembly 50 having proximal 56 and distal 55 end portions. The firearm scope connecting assembly 50 is advantageously adapted to be connected to a medial portion of the top member 34 of the pivot base 30. A firearm scope 22 can therefore be positioned to matingly contact the firearm scope connecting assembly 50. The firearm scope connecting assembly 50 can also advantageously include a plate member 58, adapted to be connected to the top member 34 of the pivot base 30. The plate member 58 can advantageously be fastened to the top member 34 of the pivot base 30 using a plurality of fasteners, such as screws, for example.

As best illustrated in FIG. 8, the firearm scope connecting assembly 50 can further advantageously include scope positioning means positioned to overlie the firearm scope connecting means for moving a firearm scope 22 in lateral and longitudinal directions. The scope positioning means can advantageously include first 54 and second 52 scope positioners. The first 54 and second 52 scope positioners can advantageously include first 64 and second 62 scope base supporters adapted to support portions of a firearm scope 22. The second scope positioner 52 is adapted to be connected adjacent the proximal end portion 56 of the firearm scope connecting assembly 50 to thereby move a firearm scope 22 connected thereto in longitudinal directions, i.e., forward and backward. The first scope positioner 54 is adapted to be connected adjacent the distal end portion 55 of the firearm scope connecting assembly 50 to thereby move a firearm scope 22 connected thereto in lateral directions, i.e., right and left.

The pin 46 of the elevation member 40 is preferably adapted to be positioned between a first lower position 72 and a second elevated position 74 along the slots 45 formed in the opposing side portions 44 of the elevation member 40. As best illustrated in FIGS. 3–5, variations between the first lower position 72 and the second elevated position 74 allow a firearm scope 22 mounted on the firearm scope connecting assembly 50 to advantageously be pivoted upwardly or downwardly. FIG. 3, for example, illustrates how the pin 46 can be positioned in the first lower position 72 for use when locating targets 80 that are positioned near the firearm 24. The first lower position 72 can advantageously be defined by a first predetermined angle $\theta_1$, formed between the top member 34 and the bottom member 32 along the bottom member 32. The first lower position 72 can advantageously be used when a projectile 28 is fired at subsonic speeds on a target 80 located near the firearm 24 as the trajectory of the projectile 28 will be more linear, although still nonlinear, than when a projectile 28 fired at subsonic speeds is fired on a target 80 located away from the firearm 24. As illustrated in FIGS. 4 and 5, when the distance between the firearm 24 and the target 80 increases, the pivot distance between the top member 34 and the bottom member 30 can be increased to account for more nonlinear paths of travel of a projectile 28 fired at subsonic speeds. The pivot distance between the top and bottom members 34, 32 of the pivot base 30 can advantageously be increased and decreased by moving the pin member 46 between the first lower position 72 and the second 74 elevated position. As the pin member 46 is raised to more accurately locate targets 80 positioned at varying distances, a second predetermined angle $\theta_2$ can be formed for locating intermediate targets 80 and a third predetermined angle $\theta_3$ can be formed for locating more long range targets 80.

As illustrated in FIG. 3, when used to locate targets 80 positioned closer to the firearm 24, the scope 22 line of sight and the trajectory of the projectile 28 intersect closer to the target 80. As best illustrated in FIGS. 4–5, as the distance between the firearm 24 and the target 80 is increased, and the angle $\theta_1$, $\theta_2$, $\theta_3$, formed between the top member 34 and the bottom member 32 is also increased, the intersection of the scope line of sight and the trajectory of the projectile 28 occurs closer to the firearm. This advantageously allows for more accurate targeting of a projectile 28 fired at subsonic speeds along varying distances.

As illustrated in FIG. 6, the pin member 46 can advantageously include a pair of tension controllers 66. The tension controllers 66 can advantageously be positioned adjacent the end portions of the pin member 46 to control tension between the pin member 46 and the slots 45 formed in opposing side portions 44 of the elevation member 40. Each of the pair of tension controllers 66 can advantageously include a first released position wherein the pin member 46 an advantageously be positioned between the first lower position 72 and the second elevated position 74. Each of the pair of tension controllers 66 can also advantageously include a second tension enhanced position wherein the pin member 46 is fixed in a position between the first lower position 72 and the second elevated position 74.

Each of the pair of tension controllers 66 can be adapted to rotate in a first predetermined direction to decrease tension between the pin member 46 and the slots 45 formed in the opposing side portions 44 of the elevation member 40. Each of the pair of tension controllers 66 can also be adapted to rotate in a second predetermined direction to increase tension between the pin member 46 and the slots 45 formed in the opposing side portions 44 of the elevation member 40. As perhaps best illustrated in FIG. 6, when the tension controllers 66 are rotated in the second predetermined direction, the pin member 46 is fixed in a position between the first lower position 74 and the second elevated position 76. The tension controllers 66 can advantageously be provided by thumb screws, for example, or any other type of fastening device capable of controlling tension such as by rotating the tension controllers 66 as understood by those skilled in the art.

The first and second scope positioners 52, 54 can further advantageously include respective first and second scope positioning slots 93, 94 formed in the firearm scope connecting assembly 50. The first and second scope positioners 54, 52 can also advantageously include first 91 and second 90 positioning pins positioned to extend through the respective first and second scope positioning slots 93, 94 formed in the firearm scope connecting assembly 50. The first and second scope positioning pins 91, 90 are preferably provided by fasteners, such as screws that are positioned to extend into portions of the firearm scope connecting assembly 50. Other types of pins, however, can also be used as understood by those skilled in the art, e.g., a pin that is large enough to be inserted into a portion of the firearm scope connecting assembly 50 so as to matingly contact the firearm scope connecting assembly 50.

The firearm scope connecting assembly 50 preferably includes an elongate longitudinal axis extending substantially the length of the firearm scope connecting assembly 50. The firearm scope connecting assembly 50 also preferably includes a lateral axis positioned substantially perpendicular to the elongate longitudinal axis. The first scope positioning slot 93 can advantageously be positioned to extend substantially parallel to the lateral axis and substantially perpendicular to the longitudinal axis to thereby provide lateral movement of a firearm scope 22 connected thereto. The second scope positioning slot 94 can advantageously be positioned substantially parallel the longitudinal axis of the firearm scope connecting assembly 50 to thereby provide longitudinal movement of a firearm scope 22 connected thereto. The first and second scope positioning slots 93, 94 advantageously allow for longitudinal and lateral movement of a firearm scope 22 connected to the firearm scope connecting assembly 50. Longitudinal and lateral movement of a firearm scope 22 advantageously allows a user to readily locate a target 80. As noted above and as best illustrated in FIG. 8, the first and second scope positioning slots 93, 94 also advantageously extend through the firearm scope connecting assembly 50 SO that the first and second scope positioning pins 91, 90 can preferably be positioned to extend into portions of the top member 34 of the pivot base 30.

The top member 34 of the pivot base 30 can also advantageously include a plurality of scope positioning pin receivers 95 formed therein. The plurality of scope positioning pin receivers 95 are preferably defined by a first scope positioning pin receiver 97 adapted to receive the first scope positioning pin 91. The plurality of scope positioning pin receivers 95 are further preferably defined by a second scope positioning pin receiver 96 adapted to receive the second scope positioning pin 90. The first scope positioning pin receiver 97 is further defined by a plurality of pin receiving each adapted to matingly receive the first scope positioning pin 91. Likewise, the second scope positioning pin receiver 96 can further be defined by a pin receiving adapted to matingly receive the second scope positioning pin 90.

The scope positioning pin receiving portions of the first and second scope positioning pin receivers 97, 96 can advantageously be threaded holes, for example, positioned to receive a threaded screw of the first 91 and second 90 scope positioning pins. The first 97 and second 96 scope positioning pin receivers can also advantageously be a hole that is large enough to receive the first and second scope positioning pins 91, 90 so that a predetermined amount of friction can be applied to hold the first and second scope positioning pins in place.

The firearm mounting assembly 20 of the present invention advantageously allows a user to position a firearm scope 22 connected thereto between a variety of positions so as to more accurately locate targets 80. The firearm scope mounting apparatus 20 of the present invention also advantageously allows a user to account for factors that affect a projectile 28 fired from a firearm 24 at subsonic speeds.

The present invention also advantageously includes methods of positioning a firearm scope 22 connected to a firearm 24 adapted to fire subsonic speed projectiles. The method can advantageously include pivoting a top member 34 of a pivot base 30 having a firearm scope 22 connected thereto. The method can also advantageously include moving a firearm scope 22 in a lateral direction when connected to the pivot base 30. The method can further advantageously include moving a firearm scope 22 in a longitudinal direction when connected to the pivot base 30.

The method of positioning a firearm scope 22 can still further advantageously include releasing the top member 34 of the pivot base 30 to thereby move the top member 34 between a first lower position 72 and a second elevated position 74. The method can also advantageously include fixing the top member 34 of the pivot base 30 to thereby fix the top member 34 between the first lower position 72 and the second elevated position 74.

The method of positioning a firearm scope 22 can also advantageously include positioning a first scope positioning pin 91 between a plurality of first scope positioning pin receivers 97 formed in the top member 34 of the pivot base 30 and positioning a second scope positioning pin 90 in a scope positioning pin receiver 97 formed in the top member 34 of the pivot base 30 so that the firearm scope 22 can be longitudinally positioned between a plurality of positions. The method can further advantageously include moving a firearm scope 22 connected to a firearm scope connecting assembly 50 between a plurality of longitudinal positions when the first scope positioning pin 91 is positioned to extend through a first positioning slot 93 formed in the base 42 of the elevation member 40. This advantageously allows the firearm scope 22 to be positioned between various longitudinal positions for ready targeting.

The method can still further advantageously include moving a firearm scope 22 connected to a firearm scope connecting assembly 50 between a plurality of lateral positions when the second scope positioning pin 90 is positioned to extend through a second positioning slot 94 formed in the base 42 of the elevation member 40. This advantageously allows the firearm scope 22 to be positioned between various lateral positions for ready targeting.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

What is claimed is:

1. A firearm scope mounting apparatus for mounting a firearm scope to a firearm, the firearm scope mounting apparatus comprising:

a pivot base adapted to be connected to an upper surface portion of the firearm, the pivot base including a bottom member and a top member overlying the bottom member and pivotally connected to the bottom member along a distal end portion thereon, the top member having at least one pin receiving slot formed therein along a proximal end portion thereof;

an elevation member adapted to be connected to the proximal end portion of the pivot base, the elevation member including a base adapted to be connected to a proximal end portion of the bottom member of the pivot base, a pair of opposing side portions extending upwardly from the base, and a pin adapted to be slidably connected to the pair of opposing side portions and to extend through the at least one pin receiving slot formed in the top member of the pivot base; and a firearm scope connecting assembly having proximal and distal end portions adapted to be connected to a medial portion of the top member of the pivot base to matingly receive a firearm scope, the firearm scope connecting assembly including a first scope positioner adapted to be connected adjacent the distal end portion of the firearm scope connecting assembly to thereby move a firearm scope connected thereto in lateral directions and a second scope positioner adapted to be connected adjacent the proximal end portion of the firearm scope connecting assembly to thereby move a firearm scope connected thereto in longitudinal directions.

2. The firearm scope mounting apparatus as defined in claim 1, wherein each of the opposing side portions of the elevation member further comprise a slot formed therein, wherein end portions of the pin are positioned to extend through the slots formed in the opposing side portions of the elevation member through which the pin slidably connects to the opposing side portions of the elevation member, and wherein the pin is adapted to be positioned between a first lower position and a second elevated position along the slots formed in the opposing side portions of the elevation member.

3. The firearm scope mounting apparatus as defined in claim 2, wherein the pin further comprises a pair of opposing tension controllers positioned adjacent the end portions of the pin to control tension between the pin and the slots formed in the opposing side portions of the elevation member, each of the pair of tension controllers having a first released position wherein the pin can be positioned between the first lower position and the second elevated position, and a second tension enhanced position wherein the pin is fixed in a position between the first lower position and the second elevated position.

4. The firearm scope mounting apparatus as defined in claim 3, wherein each of the pair of tension controllers rotate in a first predetermined direction to decrease tension between the pin and the slots formed in the opposing side portions of the elevation member and a second predetermined direction to increase tension between the pin and the slots formed in the opposing side portions of the elevation member, to thereby allow the pin to be fixed in a position between the first lower position and the second elevated position.

5. The firearm scope mounting apparatus as defined in claim 4, wherein the first and second scope positioners further comprise respective first and second scope positioning slots formed in the firearm scope connecting assembly, and respective first and second scope positioning pins positioned to extend through the respective first and second scope positioning slots formed in the firearm scope connecting assembly.

6. The firearm scope mounting apparatus as defined in claim 5, wherein the first scope positioning slot is positioned substantially perpendicular a longitudinal axis of the firearm scope connecting assembly to thereby provide lateral movement of a firearm scope connected thereto and wherein the second scope positioning slot is positioned substantially parallel the longitudinal axis of the firearm scope connecting assembly to thereby provide longitudinal movement of a firearm scope connected thereto.

7. The firearm scope mounting apparatus as defined in claim 6, wherein the top member of the pivot base further comprises a plurality of scope positioning pin receivers formed therein and defined by a first scope positioning pin receiver adapted to receive the first scope positioning pin, and a second scope positioning pin receiver adapted to receive the second scope positioning pin.

8. The firearm scope mounting apparatus as defined in claim 7, wherein the first scope positioning pin receiver further comprises a plurality of pin receiving portions each adapted to matingly receive the first scope positioning pin and wherein the second scope positioning pin receiver further comprises a pin receiving portion adapted to matingly receive the second scope positioning pin.

9. A firearm scope mounting apparatus for mounting a firearm scope to a firearm, the firearm scope mounting apparatus comprising:

a pivot base having a bottom member adapted to be connected to a firearm and a top member overlying the bottom member and pivotally connected to the bottom member along a distal end portion thereof;

elevating means adapted to be connected to a proximal end portion of the pivot base for elevating the top member of the pivot base above the bottom member along the proximal end portion thereof to thereby increase the distance between the top and bottom members of the pivot base adjacent the proximal end portion of the pivot base;

firearm scope connecting means positioned to connect to a medial portion of the top member of the pivot base adapted for matingly receiving a firearm scope; and scope positioning means positioned to overlie the firearm scope connecting means for moving a firearm scope in lateral and longitudinal directions.

10. The firearm scope mounting apparatus as defined in claim 9, wherein the top member of the pivot base further comprises a pin receiving slot formed therein along a proximal end portion thereof and wherein the elevating means further comprises an elevation member having a base adapted to be connected to a proximal end portion of the bottom member, a pair of opposing side portions extending upwardly from the base, and a pin adapted to be slidably connected to the pair of opposing side portions and to extend through the pin receiving slot.

11. The firearm scope mounting apparatus as defined in claim 10, wherein the firearm scope connecting means further comprises a firearm scope connecting assembly having proximal and distal end portions and wherein the scope positioning means further comprises a first scope positioner adapted to be connected adjacent the distal end portion of the firearm scope connecting assembly to thereby move a firearm scope connected thereto in lateral directions and a second scope positioner adapted to be connected adjacent the proximal end portion of the firearm scope connecting assembly to thereby move a firearm scope connected thereto in longitudinal directions.

12. The firearm scope mounting apparatus as defined in claim 11, wherein each of the opposing side portions of the elevation member further comprise a slot formed therein, wherein end portions of the pin are positioned to extend through the slots formed in the opposing side portions of the elevation member through which the pin slidably connects to the opposing side portions of the elevation member, and wherein the pin is adapted to be positioned between a first lower position and a second elevated position along the slots formed in the opposing side portions of the elevation member.

13. The firearm scope mounting apparatus as defined in claim 12, wherein the pin further comprises a pair of opposing tension controllers positioned adjacent the end portions of the pin to control tension between the pin and the slots formed in the opposing side portions of the elevation member, each of the pair of tension controllers having a first released position wherein the pin can be positioned between the first lower position and the second elevated position, and a second tension enhanced position wherein the pin is fixed in a position between the first lower position and the second elevated position.

14. The firearm scope mounting apparatus as defined in claim 13, wherein each of the pair of tension controllers rotate in a first predetermined direction to decrease tension between the pin and the slots formed in the opposing side portions of the elevation member and a second predetermined direction to increase tension between the pin and the slots formed in the opposing side portions of the elevation member, to thereby allow the pin to be fixed in a position between the first lower position and the second elevated position.

15. The firearm scope mounting apparatus as defined in claim 14, wherein the first and second scope positioners further comprise respective first and second scope positioning slots formed in the firearm scope connecting assembly, and respective first and second scope positioning pins positioned to extend through the respective first and second scope positioning slots formed in the firearm scope connecting assembly.

16. The firearm scope mounting apparatus as defined in claim 15, wherein the first scope positioning slot is positioned substantially perpendicular a longitudinal axis of the firearm scope connecting assembly to thereby provide lateral movement of a firearm scope connected thereto and wherein the second scope positioning slot is positioned substantially parallel the longitudinal axis of the firearm scope connecting assembly to thereby provide longitudinal movement of a firearm scope connected thereto.

17. The firearm scope mounting apparatus as defined in claim 16, wherein the top member of the pivot base further comprises a plurality of scope positioning pin receivers formed therein and defined by a first scope positioning pin receiver adapted to receive the first scope positioning pin, and a second scope positioning pin receiver adapted to receive the second scope positioning pin.

18. The firearm scope mounting apparatus as defined in claim 17, wherein the first scope positioning pin receiver further comprises a plurality of pin receiving portions each adapted to matingly receive the first scope positioning pin and wherein the second scope positioning pin receiver further comprises a pin receiving portion adapted to matingly receive the second scope positioning pin.

19. A firearm scope mounting apparatus for mounting a firearm scope to a firearm, the firearm scope mounting apparatus comprising:

a pivot base having a bottom member adapted to be connected to a firearm and a top member overlying the bottom member and pivotally connected to the bottom member along a distal end portion thereof;

an elevation member adapted to be connected to a proximal end portion of the pivot base to elevate the top member of the pivot base above the bottom member of the pivot base along the proximal end portion thereof and thereby increase the distance between the top and bottom members of the pivot base adjacent the proximal end portion of the pivot base;

a firearm scope connector positioned to connect to a medial portion of the top member of the pivot base and adapted to connect a firearm scope to the pivot base; and a scope positioner adapted to overlie the firearm scope connector to move a firearm scope in lateral and longitudinal directions.

20. The firearm scope mounting apparatus as defined in claim 19, wherein the top member of the pivot base further comprises a pin receiving slot formed therein along a proximal end portion thereof and wherein the elevation member further comprises a base adapted to be connected to the proximal end portion of the bottom member, a pair of opposing side portions extending upwardly from the base, and a pin adapted to be slidably connected to the pair of opposing side portions and to extend through the pin receiving slot.

21. The firearm scope mounting apparatus as defined in claim 20, wherein the firearm scope connector further comprises proximal and distal end portions and wherein the scope positioner further comprises a first scope positioner adapted to be connected adjacent the distal end portion of the firearm scope connecting assembly to thereby move a firearm scope connected thereto in lateral directions and a second scope positioner adapted to be connected adjacent the proximal end portion of the firearm scope connecting assembly to thereby move a firearm scope connected thereto in longitudinal directions.

22. The firearm scope mounting apparatus as defined in claim 21, wherein each of the opposing side portions of the elevation member further comprise a slot formed therein, wherein end portions of the pin are positioned to extend through the slots formed in the opposing side portions of the elevation member through which the pin slidably connects to the opposing side portions of the elevation member, and wherein the pin is adapted to be positioned between a first lower position and a second elevated position along the slots formed in the opposing side portions of the elevation member.

23. The firearm scope mounting apparatus as defined in claim 22, wherein the pin further comprises a pair of opposing tension controllers positioned adjacent the end portions of the pin to control tension between the pin and the slots formed in the opposing side portions of the elevation member, each of the pair of tension controllers having a first released position wherein the pin can be positioned between the first lower position and the second elevated position, and a second tension enhanced position wherein the pin is fixed in a position between the first lower position and the second elevated position.

24. The firearm scope mounting apparatus as defined in claim 23, wherein each of the pair of tension controllers rotate in a first predetermined direction to decrease tension between the pin and the slots formed in the opposing side portions of the elevation member and a second predetermined direction to increase tension between the pin and the slots formed in the opposing side portions of the elevation member, to thereby allow the pin to be fixed in a position between the first lower position and the second elevated position.

25. The firearm scope mounting apparatus as defined in claim 24, wherein the first and second scope positioners further comprise respective first and second scope positioning slots formed in the firearm scope connecting assembly, and respective first and second scope positioning pins positioned to extend through the respective first and second scope positioning slots formed in the firearm scope connecting assembly.

26. The firearm scope mounting apparatus as defined in claim 25, wherein the first scope positioning slot is positioned substantially perpendicular a longitudinal axis of the firearm scope connecting assembly to thereby provide lateral movement of a firearm scope connected thereto and wherein the second scope positioning slot is positioned substantially parallel the longitudinal axis of the firearm scope connecting assembly to thereby provide longitudinal movement of a firearm scope connected thereto.

27. The firearm scope mounting apparatus as defined in claim 26, wherein the top member of the pivot base further comprises a plurality of scope positioning pin receivers formed therein and defined by a first scope positioning pin receiver adapted to receive the first scope positioning pin, and a second scope positioning pin receiver adapted to receive the second scope positioning pin.

28. The firearm scope mounting apparatus as defined in claim 27, wherein the first scope positioning pin receiver further comprises a plurality of pin receiving portions each adapted to matingly receive the first scope positioning pin and wherein the second scope positioning pin receiver further comprises a pin receiving portion adapted to matingly receive the second scope positioning pin.

29. A method of positioning a firearm scope connected to a firearm comprising:

pivoting a top member of a pivot base having a firearm scope connected thereto relative to a bottom member of the pivot base to adjust the elevation;

moving a firearm scope in a lateral direction when connected to the pivot base; and moving a firearm scope in a longitudinal direction connected to the pivot base.

30. The method as defined in claim 29, further comprising releasing the top member of the pivot base to thereby move the top member between a lower position and an elevated position.

31. The method as defined in claim 30, further comprising fixing the top member of the pivot base to thereby fix the top member between the lower position and the elevated position.

* * * * *